United States Patent [19]

Salay

[11] Patent Number: 4,719,443

[45] Date of Patent: Jan. 12, 1988

[54] LOW CAPACITANCE POWER RESISTOR USING BERYLLIA DIELECTRIC HEAT SINK LAYER AND LOW TOXICITY METHOD FOR ITS MANUFACTURE

[75] Inventor: Steven J. Salay, Lynchburg, Va.

[73] Assignee: General Electric Company, Lynchburg, Va.

[21] Appl. No.: 847,689

[22] Filed: Apr. 3, 1986

[51] Int. Cl.[4] ..... H01C 1/012

[52] U.S. Cl. ..... 338/314

[58] Field of Search ..... 338/314, 307, 308, 309, 338/316, 195; 29/610 R, 611, 620; 219/216

[56] References Cited

U.S. PATENT DOCUMENTS

| | | | |
|---|---|---|---|
| 3,315,200 | 4/1967 | Hannay | 338/314 X |
| 3,478,191 | 11/1969 | Johnson et al. | 219/216 PH |
| 3,481,306 | 12/1969 | O'Connell et al. | 118/8 |
| 3,486,221 | 12/1969 | Robinson | 29/620 |
| 3,515,850 | 6/1970 | Cady, Jr. | 219/216 PH |
| 4,103,275 | 7/1978 | Diehl et al. | 338/314 X |
| 4,288,776 | 9/1981 | Holmes | 338/308 |
| 4,358,748 | 11/1982 | Gruner et al. | 338/25 |

FOREIGN PATENT DOCUMENTS

| | | | |
|---|---|---|---|
| 0141701 | 11/1980 | Japan | 338/314 |

*Primary Examiner*—C. L. Albritton

*Attorney, Agent, or Firm*—Nixon & Vanderhye

[57] ABSTRACT

A thin alumina support substrate is printed with a resistive thick film and trimmed to the desired resistance value so as to avoid undue toxicity during the trimming process. The thus formed thick film resistor on an alumina substrate is then solder-bonded to a relatively thick beryllia (BeO) dielectric heat sink which, in the exemplary embodiment, is in turn also solder-bonded on its opposite side to a larger metallic heat sink.

11 Claims, 4 Drawing Figures

LOW CAPACITANCE POWER RESISTOR USING BERYLLIA DIELECTRIC HEAT SINK LAYER AND LOW TOXICITY METHOD FOR ITS MANUFACTURE

This invention is generally directed to a low capacitance power resistor using a dielectric BeO heat sink and low toxicity methods of fabricating such a resistor.

It is often important (e.g., for radio frequency applications) to limit the parasitic capacitance associated with a resistor. With respect to thick film printed resistors, this means there are upper limits on the permissible surface area of the printed resistive material and/or its power dissipating capabilities.

It is known that such upper limits can be increased by using dielectric heat sink materials (i.e., to increase the spacing between the resistive film and an underlying larger metallic heat sink structure). One such known dielectric heat sink material is beryllia (BeO). By thus spacing the resistive film from grounded metallic structures, the parasitic capacitance can be decreased. It is also well-known that bonding a thick film resistor to a heat sink (whether non-conductive or conductive) permits one to dissipate much more power than if the device is cooled only by air currents.

It is also well-known that thick film resistors must be "trimmed" (e.g., with a laser or other focused energy beam device) after some initial manufacturing steps so as to cause the final resistance value to be within desired tolerances.

Unfortunately, when thick film resistors are printed directly onto beryllia heat sink substrates, the requisite laser trimming operation generates very toxic fumes (e.g., beryllia dust) which requires cumbersome and/or expensive arrangements to insure a safe trimming operation.

Some (non-limiting) examples of possibly related prior art are

U.S. Pat. No. 3,481,306—O'Connell et al (1969)
U.S. Pat. No. 3,486,221—Robinson (1969)
U.S. Pat. No. 4,288,776—Holmes (1981)
U.S. Pat. No. 4,268,954—Sease et al (1981)
U.S. Pat. No. 4,358,748—Gruner et al (1982)

O'Connell et al, Robinson and Holmes both teach techniques for trimming film electrical components. Holmes uses a passivated coating, at least in part, to reduce toxicity during trimming operations. Robinson also uses such a passivation coating specifically to avoid BeO dust during trimming operations where a BeO substrate is employed. Sease et al and Gruner et al also relate generally to the formation and/or trimming of film resistors and the like on various types of substrates.

I have discovered a novel structure and method of fabrication which avoids the need for a toxic trimming process while, at the same time, still permitting effective use of a beryllia dielectric heat sinking substrate.

In brief, the desired thick film resistor is first printed onto a very thin but still mechanically sound alumina substrate and laser trimmed to the desired final value. Use of such a non-toxic print substrate insures a non-toxic laser trimming operation. While the non-toxic substrate must be thick enough to be mechanically sound (i.e., so as to permit the desired printing, firing and trimming operations and the like), it is preferably maintained as thin as otherwise possible so as to maximize efficient heat transfer through this substrate layer which is not as good a heat conductor as BeO.

Then, instead of bonding this finished resistor directly to a metallic heat sink. it is bonded to the metallic heat sink with a beryllia (BeO) chip soldered between the thin alumina supporting substrate and the metallic heat sink. This soldering operation is also conventional, safe, non-toxic and requires no particular safety precautions.

Beryllia has a heat conductivity about seven times that of alumina at room temperature. Thus, even a "thick" lamination of beryllia only slightly degrades the overall heat sinking capability of the composite structure. However, beryllia being a good insulator with a dielectric constant even less than that of alumina, significantly decreases the parasitic capacitance to ground (i.e.. to the grounded metallic major heat sink). The relatively thin alumina substrate assures good heat transfer from the resistive film to the heat sinked side of the structure due to its relative thinness. As will be appreciated, the same desirable thinness of the alumina substrate would result in a relatively larger parasitic capacitance if bonded directly to the metallic heat sink rather than on top of the intermediate beryllia dielectric heat sinking substrate.

In this manner, the advantages of the alumina substrate and of a beryllia substrate are simultaneously achieved while also minimizing or avoiding disadvantages associated with each. Conventional laser trimming of the resistor on the alumina is safe and non-toxic while use of the intermediate beryllia chip provides good heat conductivity and reduced parasitic capacitance to ground.

These as well as other objects and advantages of this invention will be better understood and appreciated by carefully reading the following detailed description of a presently preferred exemplary embodiment of the invention taken in conjunction with the accompanying drawings, of which:

Figure 1:
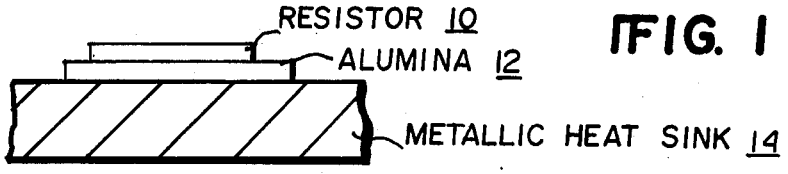
FIG. 1 PRIOR ART
FIG. 1 is a cross-sectional depiction of a prior art structure utilizing a printed resistive film on an alumina substrate which is directly bonded to a metallic heat sink.

As depicted in FIG. 1, a conventional resistive film 10 is printed directly onto an alumina substrate 12 and conventionally processed (e.g., by firing and trimming), to provide resistance of predetermined value. The structure is then directly bonded (e.g., by soldering) to a metallic heat sink 14 so as to provide desirable power dissipation capabilities for the resistive film 10. While such a prior art structure is quite safe to manufacture, when relatively thin layers of alumina are utilized (so as to maximize heat transfer to the metallic heat sink), relatively high parasitic capacitance is produced.

Figure 2:
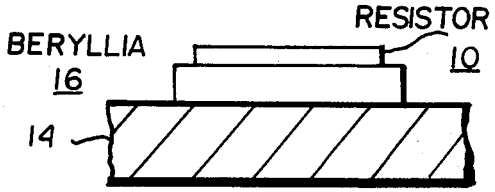
FIG. 2 PRIOR ART
FIG. 2 depicts a similar cross-sectional view of another prior art arrangement where a resistive film is printed directly onto a beryllia substrate which is, in turn, directly bonded to the metallic heat sink.

On the other hand, another prior art approach as depicted in FIG. 2 permits the resistive film 10 to be disposed at a substantially greater distance above the metal heat sink 14 by a beryllia substrate 16 thus reducing parasitic capacitance. In brief, since beryllia is a much better heat conductor than alumina, a greater thickness of beryllia insulation can be tolerated without unduly degrading the heat dissipation capabilities of the overall structure. Unfortunately, the requisite laser trimming of resistor 10 when disposed directly on the beryllia substrate 16 produces very toxic fumes and therefore requires expensive and elaborate equipment/-procedures during the trimming proces.

Figure 3:
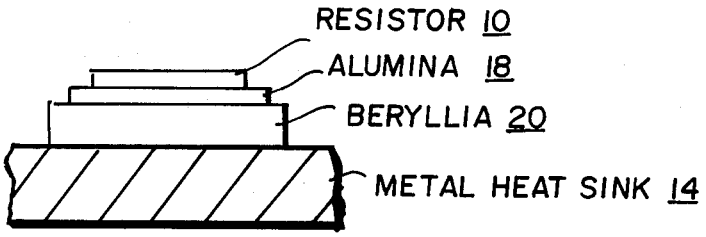
FIG. 3 is a cross-sectional depiction of an exemplary embodiment of the present invention where a resistive film is printed onto an alumina substrate which is then bonded to an intermediate beryllia substrate which is, in turn, bonded to the metallic heat sink.

In the exemplary embodiment of FIG. 3, the same resistive film 10 is now printed on a relatively thin supporting substrate 18 of alumina. The alumina substrate 18 is preferably made as thin as possible while yet retaining sufficient mechanical strength to permit the resistive film 10 to be printed thereonto. fired and trimmed in conventional non-toxic operations.

Thereafter, the finished resistor 10 and its alumina substrate 18 is bonded (e.g., by conventional solder bonding) to the metallic heat sink 14 via an intermediate dielectric heat sink layer 20 of beryllia. As will be understood, while beryllia is not an electrical conductor, it is nevertheless a relatively good conductor of heat when compaired to aluminia. In this sense, it is referred to as a "heat sink" in the context of the present description.

Figure 4:
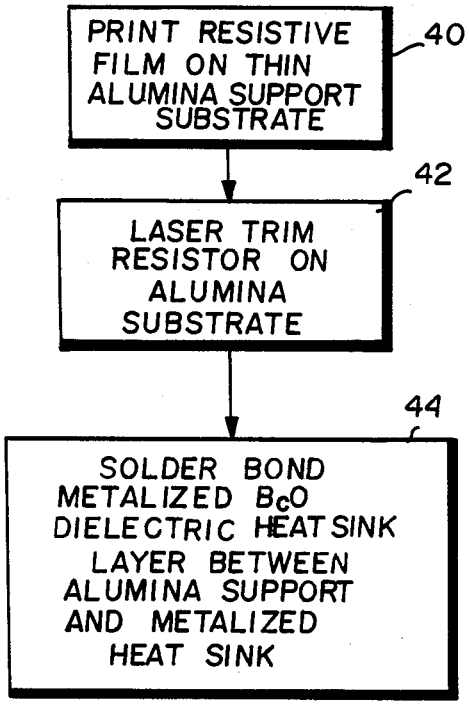
FIG. 4 is a simplified flowchart depicting an exemplary process of fabricating the exemplary embodiment of FIG. 3.

One exemplary process for fabrication of the improved resistor is depicted at FIG. 4. Here, at step 40, a resistive film is conventionally printed on a thin alumina support substrate. While the support substrate is thick enough to provide desired mechanical support, it is otherwise as thin as possible so as to enhance good heat transfer therethrough in the finished product.

Subsequently, at step 42, the fired resistive film is conventionally laser trimmed in a non-toxic trimming operation.

Then, instead of directly bonding the finished resistor to a metallic heat sink, step 44 instead bonds it to the heat sink with a beryllia chip soldered between the alumina and the metallic heat sink. Step 44 is thus also a safe operation requiring no particular unique safety precautions. Typically, the beryllia chip will first be bonded to the metallic heat sink and, subsequently, the laser trimmed resistor already on its alumina substrate will then be soldered to the other side of the beryllia chip. As will be appreciated, the areas of the beryllia chip which are to be solder-bonded would typically first be metallized using conventional known metallizing operations. Since the beryllia chip has much higher heat conductivity than alumina, even a relatively "thick" intermediate beryllia layer only slightly degrades the overall heat sinking capability of the composite structure. At the same time, beryllia is a quite good insulator having a dielectric constant even less than that of alumina thus decreasing the parasitic capacitance to ground and achieving the desired low capacitance power resistor structure.

While only few exemplary embodiments of this invention have been described in detail, those skilled in the art will recognize that variations and modifications may be made while yet retaining many of the novel features and advantages of this invention. Accordingly, all such variations and modifications are intended to be included within the scope of the appended claims.

Two examples of possible embodiments are further described in the following tabulation:

| | Example 1 | Example 2 |
|---|---|---|
| Thickness of alumina substrate with resistor printed on it [cm] | 0.0635 | 0.0305 |
| Resistor area [$cm^2$], length of side of square [cm] | 0.113/0/336 | 0.132/.36 |
| Temperature of top of resistor, [°C.] | 150 | 150 |
| Temperature of heat sink [°C.] | 85 | 85 |
| Termperature of beryllia chip, [°] | — | 95 |
| Total capacitance to ground, $p^F$ | 1.5 | 1.5 |
| Power dissipation capability, W | 24 | 50 |
| Size of Beryllia Chip: | 0.25" × 0.25" × 0.020", metallized on one side and metallized on a 0.180 × 0.180 square on the other side. | |

What is claimed is:

1. A low capacitance power resistor comprising:

a resistive film printed and trimmed on a first side of an alumina support substrate layer which alumina support substrate also has an opposite second side; and a dielectric heat sink layer including BeO bonded on a first side to said opposite second side of said alumina support substrate.

2. A resistor as in claim 1 further comprising a metallic heat sink bonded to an opposite second side of said dielectric heat sink layer.

3. A low capacitance power resistor comprising:

a resistive film printed and trimmed on a first side of a support substrate layer which support substrate also has an opposite second side; and a dielectric heat sink layer including BeO bonded on a first side to said opposite second side of said support substrate;

wherein said support substrate layer comprises alumina.

4. A low capacitance power resistor comprising:

a resistive film printed and trimmed on a first side of a support substrate layer which support substrate also has an opposite second side; and a dielectric heat sink layer including BeO bonded on a first side to said opposite second side of said support substrate;

a metallic heat sink bonded to an opposite second side of said dielectric heat sink layer;

wherein said support substrate layer comprises alumina.

5. A resistor as in claim 2 wherein said dielectric heat sink layer includes metallized areas bonded with solder to said support substrate and to said metallic heat sink.

6. A resistor comprising:

a metallic heat sink;

a dielectric heat sink layer comprising BeO bonded on top of said metallic heat sink;

a heat sink support substrate comprising alumina bonded on its bottom side to the top side of said dielectric heat sink layer; and a resistive film deposited on the top side of said support substrate.

7. A resistor comprising:

a metallic heat sink;

a dielectric heat sink layer bonded on top of said metallic heat sink;

a support substrate bonded on its bottom side to the top side of said dielectric heat sink layer; and a resistive film deposited on the top side of said support substrate;

wherein said support substrate comprises alumina.

8. A resistor comprising:

a metallic heat sink;

a dielectric heat sink layer bonded on top of said metallic heat sink;

a support substrate bonded on its bottom side to the top side of said dielectric heat sink layer; and a resistive film deposited on the top side of said support substrate;

wherein said dielectric heat sink layer comprises BeO and said support substrate comprises alumina; and wherein said dielectric heat sink includes metallized areas on its top and bottom sides, said metallized areas being bonded with solder to said metallic heat sink and to said support substrate respectively.

9. A low toxicity method of making a low capacitance power resistor using a dielectric BeO heat sink material, said material comprising the steps of:

depositing a resistive film material on one side of an alumina support substrate;

trimming the thus deposited resistive film to a predetermined value of resistance; and bonding the other side of said alumina support substrate to a dielectric BeO heat sink.

10. A method as in claim 9 wherein said dielectric BeO heat sink is also bonded on an opposite side to a metallic heat sink.

11. A method as in claim 10 wherein said dielectric BeO heat sink comprises a layer of BeO having first and second sides which are metallized in at least some areas and wherein said bonding steps are performed by soldering operations.

* * * * *